US007387002B2

(12) United States Patent
Clark et al.

(10) Patent No.: US 7,387,002 B2
(45) Date of Patent: Jun. 17, 2008

(54) VIBRATION DAMPING PUMP BRACKET

(75) Inventors: Brian D. Clark, Des Moines, IA (US); Daryl T. Johnson, Grinnell, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 829 days.

(21) Appl. No.: 10/792,320

(22) Filed: Mar. 2, 2004

(65) Prior Publication Data

US 2005/0196294 A1 Sep. 8, 2005

(51) Int. Cl.
*D06F 39/08* (2006.01)

(52) U.S. Cl. ..... 68/207; 68/184; 248/560

(58) Field of Classification Search ..... 68/207, 68/208, 184; 134/56 D, 57 D; 248/560, 248/634, 635, 632, 568–570, 580–599
See application file for complete search history.

(56) References Cited

U.S. PATENT DOCUMENTS

| | | | | | |
|---|---|---|---|---|---|
| 2,089,066 | A | * | 8/1937 | Morrill | 310/272 |
| 2,251,564 | A | | 8/1941 | Conterman | |
| 2,701,574 | A | * | 2/1955 | Hollerith | 134/57 D |
| 2,880,740 | A | | 4/1959 | Peglow | |
| 2,881,995 | A | * | 4/1959 | Neher | 248/604 |
| 3,057,218 | A | * | 10/1962 | Knerr et al. | 474/2 |
| 3,242,871 | A | | 3/1966 | Mercer | |
| 3,445,059 | A | | 5/1969 | Hannibal et al. | |
| 3,509,393 | A | * | 4/1970 | Roddy | 310/51 |
| 3,583,835 | A | | 6/1971 | Coburn et al. | |
| 3,603,121 | A | * | 9/1971 | Burkland | 68/23.4 |
| 3,787,014 | A | * | 1/1974 | Story et al. | 248/558 |
| 4,306,841 | A | | 12/1981 | Morrison et al. | |
| 4,713,714 | A | * | 12/1987 | Gatti et al. | 360/137 |
| 4,757,786 | A | * | 7/1988 | Ellegard | 123/2 |
| 4,946,351 | A | | 8/1990 | Richardson, Jr. | |
| 5,020,767 | A | * | 6/1991 | Ueda et al. | 248/638 |
| 5,044,883 | A | * | 9/1991 | Neueder | 415/214.1 |
| 5,110,266 | A | * | 5/1992 | Toyoshima et al. | 417/312 |
| 5,118,254 | A | | 6/1992 | Ellingson et al. | |
| 5,174,318 | A | | 12/1992 | Dingler et al. | |
| 5,649,812 | A | | 7/1997 | Schoenmeyr et al. | |
| 5,688,030 | A | | 11/1997 | McAnally et al. | |
| 5,975,846 | A | * | 11/1999 | Wistinghausen | 415/206 |
| 6,011,336 | A | | 1/2000 | Mathis et al. | |
| 6,141,995 | A | | 11/2000 | Johnson | |
| 6,234,445 | B1 | * | 5/2001 | Yoon | 248/638 |
| 6,352,247 | B1 | * | 3/2002 | Ishikawa et al. | 267/140.11 |
| 6,481,246 | B1 | | 11/2002 | Johnson et al. | |
| 6,484,738 | B1 | | 11/2002 | Andrews et al. | |

(Continued)

FOREIGN PATENT DOCUMENTS

| | | | |
|---|---|---|---|
| DE | 27 04 455 | * | 8/1978 |

(Continued)

*Primary Examiner*—Frankie L. Stinson
(74) *Attorney, Agent, or Firm*—Clifton Green; Michael D. LaFrenz

(57) ABSTRACT

A mounting bracket is provided for a pump of a washing machine. The bracket includes a body adapted to twist lock mount onto the base of the washing machine. The pump is adapted to twist lock mount onto the body of the bracket. The bracket includes one or more dampers to dampen vibrations generated by the pump during operation so as to produce a quiet operating washing machine.

26 Claims, 3 Drawing Sheets

U.S. PATENT DOCUMENTS

| | | | |
|---|---|---|---|
| 6,491,504 | B2 | 12/2002 | Nakagaki et al. |
| 2002/0015647 | A1 | 2/2002 | Nakagaki et al. |

FOREIGN PATENT DOCUMENTS

| | | | |
|---|---|---|---|
| DE | 27 10 616 | * | 9/1978 |
| FR | 2 479 385 | * | 10/1981 |
| GB | 1 169 754 | * | 7/1986 |
| JP | 60-203529 | * | 10/1985 |
| JP | 405202846 A | | 8/1993 |
| JP | 6-167040 | * | 6/1994 |
| JP | 2000-350896 | * | 12/2000 |
| JP | 2001-304200 | * | 10/2001 |

* cited by examiner

VIBRATION DAMPING PUMP BRACKET

BACKGROUND OF THE INVENTION

Washing machines include a pump which is normally mounted to the base of the machine to drain water from the tub. The pump generates vibrations during operation which are transmitted to the base, and then to the rest of the machine. These vibrations increase the noise level of the operating machine, which is undesirable.

Accordingly, a primary objective of the present invention is the provision of a pump mounting bracket which dampens pump vibrations so as to produce a quiet washing machine.

Another objective of the present invention is the provision of a vibration damping pump mount or bracket which allows quick and easy installation of the pump to the washing machine base.

A further objective of the present invention is the provision of a washing machine pump mounting bracket having a rubber damper to isolate the pump and dampen the pump vibrations.

Still another objective of the present invention is the provision of a pump bracket having a resilient body with dampers installed in the body to absorb pump vibrations.

Yet another objective of the present invention is the provision of an improved washing machine having a pump mounted to the base of the machine using a vibration damping bracket.

Another objective of the present invention is the provision of a washing machine having a pump bracket which allows for twist mounting of the pump to the bracket and twist mounting of the bracket to the machine.

A further objective of the present invention is the provision of a washing machine pump mount which is economical to manufacture and durable in use.

These and other objectives will become apparent from the following description of the invention.

SUMMARY OF THE INVENTION

A mounting bracket is provided for a pump of a washing machine having a base to which the bracket and pump assembly are mounted. The pump bracket includes a body with a lower portion adapted to twist lock to the base of the washing machine and an upper portion to receive the pump by twist lock action. The body includes a damper between the upper and lower portions to dampen the vibrations generated by the pump during operation. The body and damper are formed as separate components, with the damper being mechanically locked or adhered to the bracket body.

DETAILED DESCRIPTION OF THE PREFERRED EMBODIMENT

Figure 1:
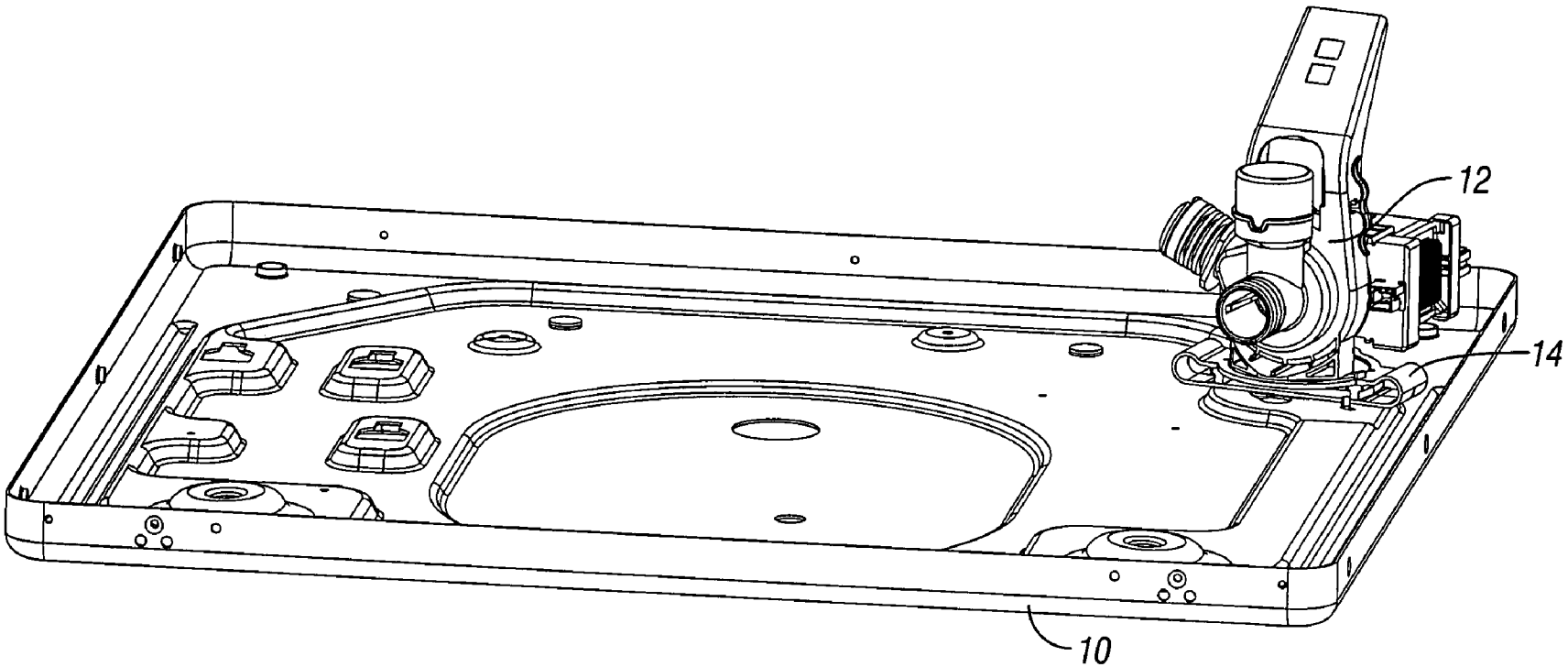
FIG. 1 is a perspective view of a washing machine base with the pump mounted thereto via the mounting bracket of the present invention.
Figure 2:
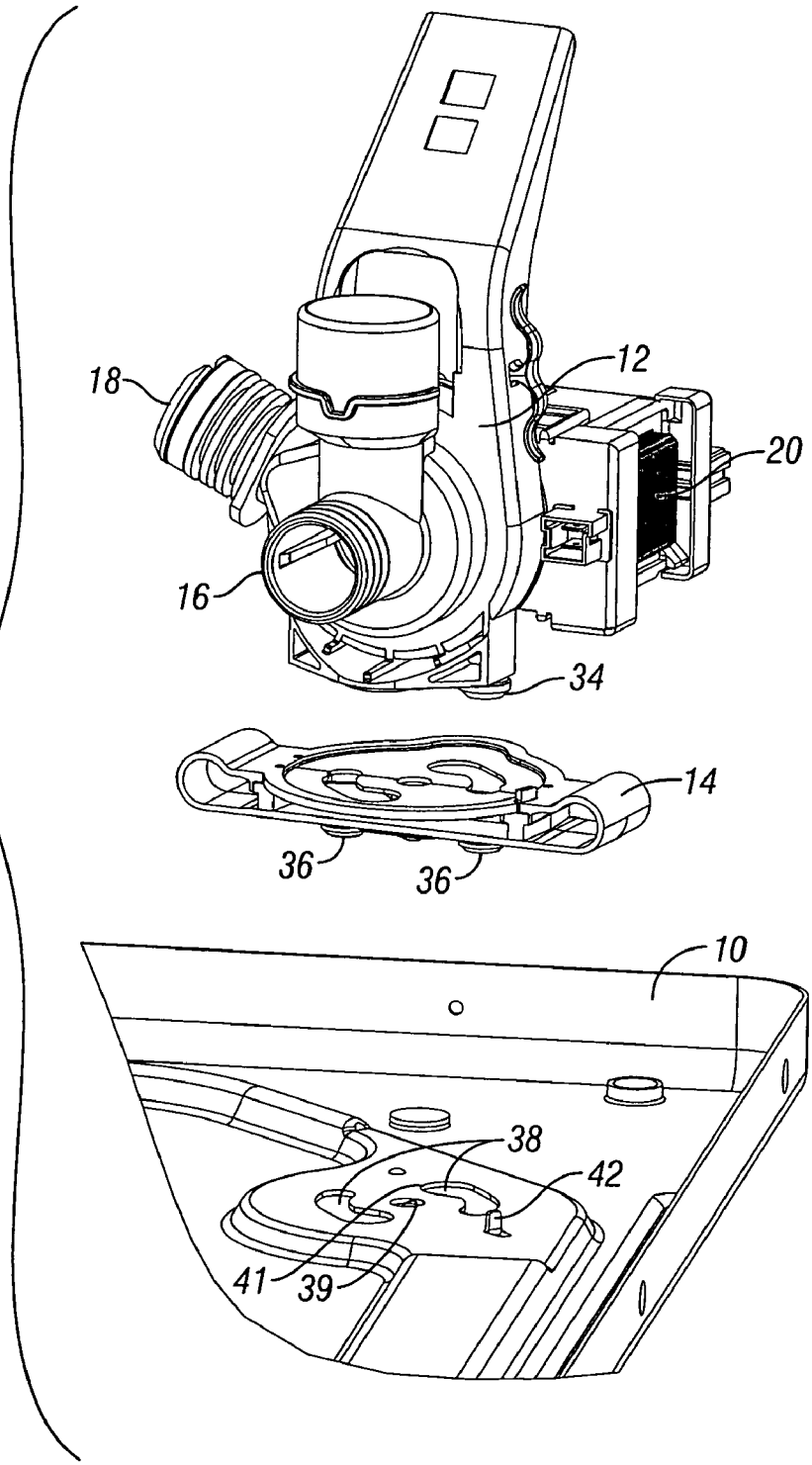
FIG. 2 is an exploded perspective view of the pump, mounting bracket, and washing machine base.

In FIGS. 1 and 2, a washing machine base is generally designated by the reference numeral 10. A pump 12 is mounted to the base 10 using a mounting bracket 14. One example of a pump is disclosed in Applicants' U.S. Pat. No. 6,481,246. The pump generally includes a water inlet line 16, a water outlet line 18, and an electric motor 20 operatively connected to the circuitry of the washing machine to control operation of the pump 12.

Figure 3:
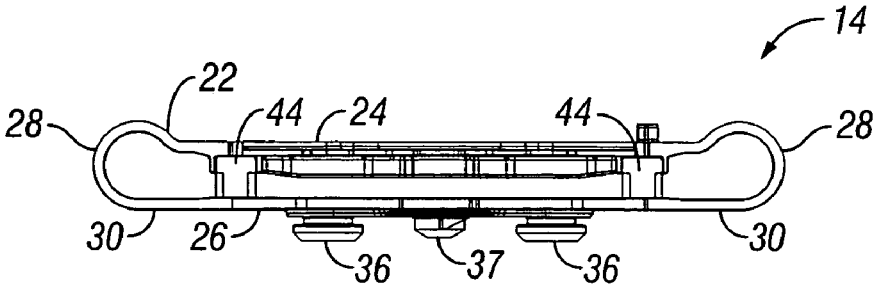
FIG. 3 is a side elevation view of the pump mounting bracket of the present invention.

The pump mount or bracket 14 includes a body 22 with an upper portion 24 and a lower portion 26. As best seen in FIG. 3, the upper and lower portions 24, 26 are interconnected by a web 28 to define C-shaped opposite ends 30.

Figure 4:
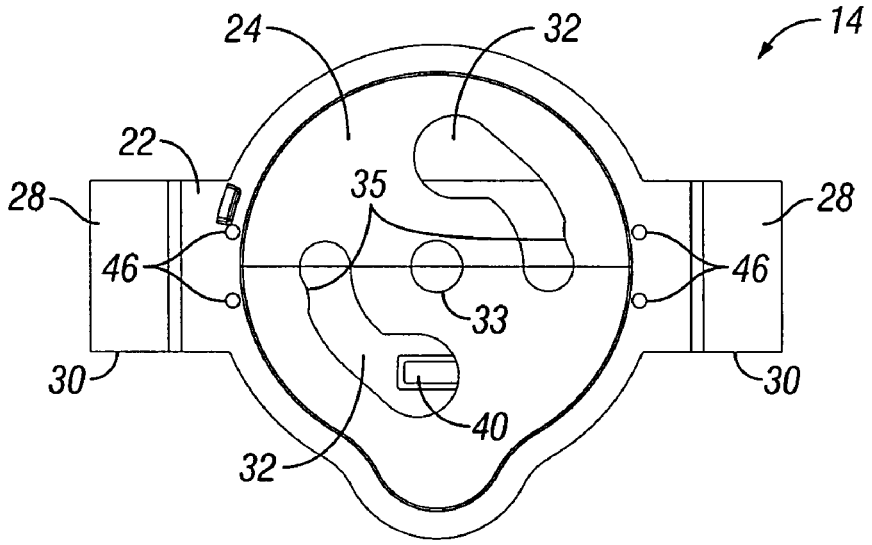
FIG. 4 is a top plan view of the pump mounting bracket of the present invention.
Figure 5:
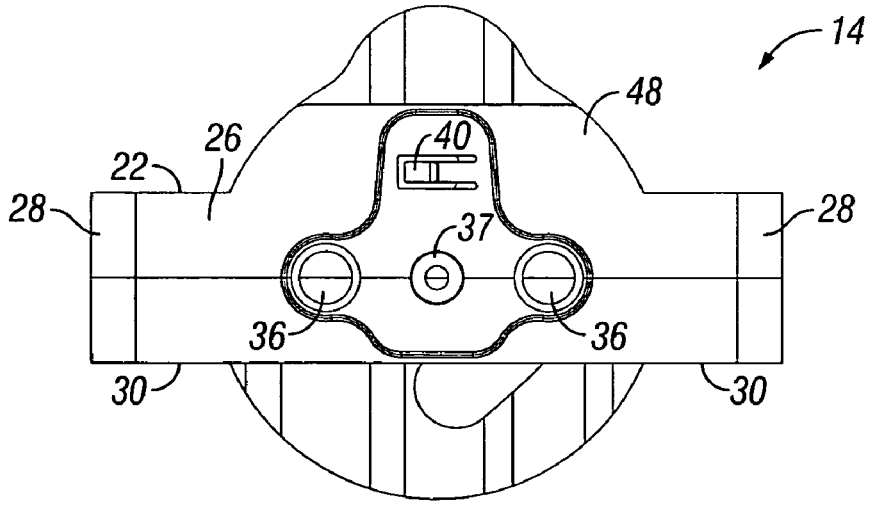
FIG. 5 is a bottom plan view of the pump mounting bracket of the present invention.

The upper portion 24 of the body 22 of the mounting bracket 14 includes keyed holes 32, as best seen in FIG. 4, which are adapted to receive legs 34 on the pump 12 for quick and easy twist lock attachment of the pump 12 to the bracket 14. A control hole 33 in the upper portion 24 is adapted to receive a center pin (not shown) on the bottom of the pump 12 to facilitate centering of the pump 12 on the bracket 14. After rotating pump 12 in keyed holes 32, locking protrusions 35 are utilized to rotationally secure legs 34 within keyed holes 32. The lower portion 26 of the body 22 of the bracket 14 includes legs 36 which are adapted to be received in keyed holes 38 on the base 10 of the washing machine for quick and easy twist lock installment of the bracket 14 to the base 10 of the machine. A center pin 37 extends from the bottom of the lower portion 26 for receipt in a hole 39 in the base 10, to facilitate positioning of the bracket 14 on the base 10. A resilient tab 40 on the lower portion 26 of the bracket 14 engages a keyed hole leading edge 41 of the base 10 to rotationally lock the bracket 14 on the base 10. The combination of asymmetric bottom portion 48 (see FIG. 5) of lower portion 26 of bracket 14 and upstanding tab 42 on the base 10 precludes improper assembly of the bracket 14 on the base 10. Engagement of asymmetric portion 48 with upstanding tab 42 prevents legs 36 from engaging keyed holes 38.

At least one damper 44 and preferably two dampers 44, are provided on the mounting bracket 14 so as to absorb vibrations generated by the pump 12 during operation. More particularly, the dampers 44 are inserted between the upper and lower portions 24, 26, as seen in FIG. 3. In the preferred embodiment, the dampers 44 are installed between the legs of the C-shaped ends 30, but alternatively can be provided in the webs 28 on the ends 30 of the mounting bracket 14.

Preferably, the body 22 of the mounting bracket 14 is a one-piece, resilient plastic material such as polypropylene and the dampers 44 are a thermoplastic elastomer or rubber material. In a preferred method of manufacture, the bracket 14 is formed in a two-shot molding process, body 22 being injection molded and then the dampers 44 being shot in a second stage of the molding process. The body 22 is provided with holes 46 into which damper material flows so as to provide a mechanical interconnection between the dampers 44 and the body 22. Alternatively, the dampers 44 may be made from a polypropylene-based thermoplastic elastomer such as santoprene from Monsanto Corporation, which would provide a surface adhesion to the body 22.

As a further alternative to the manufacturing process, the dampers 44 can be made and then press fit between the upper and lower portions 24, 26 of the body 22.

In the assembly process, the pump 12 is quickly and easily twist-locked onto the bracket 14, with the pump and bracket assembly then being quickly and easily twist locked onto the base 10 without the use of tools. This mounting arrangement similarly allows for quick and easy disassembly of the pump 12 for servicing by a repair man.

During operation of the pump 12, vibrations are absorbed by the dampers 44 and by the resilient body 22 so as to minimize transmission of the vibrations to the base 10 and other components of the washing machine, thereby minimizing the noise of the operating machine.

Although not required, legs 36 of bracket 14 are preferably identical in size and spacing to legs 34 of pump 12. Similarly, keyed holes 32 of bracket 14 are preferably identical to keyed holes 38 in base 10. This arrangement allows the pump to be assembled directly to the base, if desired. In this manner, the vibration damping pump bracket 14 may be utilized as an enhancement feature on selected models of a product line.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A mounting bracket for a pump of a washing machine, the machine having a base, the mounting bracket, comprising:

a single piece resilient body having a lower portion with at least two legs extending therefrom adapted to mount on the washing machine base, an upper portion with at least two holes configured to receive legs from the pump to support the pump, and a web interconnecting a first end of the lower portion to a first end of the upper portion and interconnecting a second end of the lower portion to a second end of the upper portion;

a damper between the upper and lower portions to dampen vibrations generated by the pump; and the body and damper being separately formed components.

2. The mounting bracket of claim 1 wherein the damper is rubber.

3. The mounting bracket of claim 1 wherein the damper is pressed between the upper and lower body portions.

4. The mounting bracket of claim 1 wherein the damper is over molded into the body.

5. The mounting bracket of claim 1 wherein the damper is injected into the body between the upper and lower portions.

6. The mounting bracket of claim 1 wherein the damper is adhered to the body.

7. The mounting bracket of claim 1 wherein the damper is mechanically locked to the body.

8. The mounting bracket of claim 7 wherein the body has a plurality of holes therein and the damper extends into the holes.

9. The mounting bracket of claim 1 wherein the body is injection molded.

10. The mounting bracket of claim 1 wherein the body is molded.

11. The mounting bracket of claim 1 wherein the legs are adapted to twist lock mount the body onto the base.

12. The mounting bracket of claim 11 wherein the body includes a tab to lock the mounting bracket to the base.

13. The mounting bracket of claim 1 wherein the body openings are adapted to twist lock mount the body onto the pump.

14. The mounting bracket of claim 13 wherein the opening have protrusions to rotationally secure legs on the pump to the mounting bracket.

15. An improved washing machine, comprising:

a base having at least two holes therein;

a pump having at least two legs extending therefrom;

a bracket for mounting the pump to the base;

the bracket including a single piece resilient body having a lower portion with at least two legs extending therefrom adapted to be received in the at least two holes in the base to mount the bracket on the washing machine base, an upper portion with at least two holes configured to receive the at least two legs from the pump to support the pump on the bracket, and a web interconnecting a first end of the lower portion to a first end of the upper portion and interconnecting a second end of the lower portion to a second end of the upper portion; and a damper installed in the bracket to dampen pump vibrations.

16. The improved washing machine of claim 15 wherein the bracket and damper are formed in separate steps.

17. The improved washing machine of claim 15 wherein the damper is an elastomeric material.

18. The improved washing machine of claim 15 wherein the bracket has a C-shaped end with opposite legs and the damper is between the legs of the C-shaped end.

19. The improved washing machine of claim 15 wherein the pump is twist locked onto the bracket and the bracket is twist locked onto the base.

20. The improved washing machine of claim 19 wherein the base has a tab to engage an asymmetric bottom portion of the bracket and thereby preclude improper assembly of the bracket on the base.

21. The improved washing machine of claim 15 wherein the damper is mechanically locked to the bracket.

22. The improved washing machine of claim 15 wherein the damper is adhered to the bracket.

23. The improved washing machine of claim 15 wherein the damper is molded onto the bracket.

24. The improved washing machine of claim 15 wherein the two holes in the base comprise keyed arcuate holes to permit a twist lock installment of the bracket onto the base and the two holes in the bracket comprise keyed arcuate holes to permit a twist lock installment of the pump onto the bracket.

25. The improved washing machine of claim 24 wherein the legs of the bracket are identical in size and spacing to the legs of the pump and the keyed holes of the bracket are identical in size and spacing to the keyed holes of the base.

26. A mounting bracket for a pump of a washing machine, the machine having a base, the mounting bracket, comprising:

a single piece resilient body having a lower portion with at least two legs and a center pin extending therefrom adapted to engage with and mount on the washing machine base, an upper portion with at least two leg holes and one control hole configured to receive at least two legs and a center pin from the pump to support the pump, and a web interconnecting at least one end of the lower portion to at least one end of the upper portion; and a damper between the upper and lower portions to dampen vibrations generated by the pump.

* * * * *